US011246340B2

(12) United States Patent
Long et al.

(10) Patent No.: US 11,246,340 B2
(45) Date of Patent: Feb. 15, 2022

(54) TOBACCO HEATER WITH STRAIGHT THROUGH HEATING TUBE

(71) Applicants: Gongyun Long, Shenzhen (CN); Hong Liu, Shenzhen (CN)

(72) Inventors: Gongyun Long, Shenzhen (CN); Hong Liu, Shenzhen (CN)

(73) Assignee: Shenzhen Coeus Technology Co, Ltd., Guangdong (CN)

( * ) Notice: Subject to any disclaimer, the term of this patent is extended or adjusted under 35 U.S.C. 154(b) by 396 days.

(21) Appl. No.: 16/390,019

(22) Filed: Apr. 22, 2019

(65) Prior Publication Data

US 2020/0008472 A1 Jan. 9, 2020

(30) Foreign Application Priority Data

Jul. 3, 2018 (CN) ..... 201810714848.9

(51) Int. Cl.

| | |
|---|---|
| ***A24F 1/32*** | (2006.01) |
| ***A24F 7/02*** | (2006.01) |
| ***E05C 19/16*** | (2006.01) |
| ***H05B 3/44*** | (2006.01) |
| ***A24F 15/015*** | (2020.01) |
| ***A24F 40/20*** | (2020.01) |
| ***A24F 40/40*** | (2020.01) |
| ***A24F 9/02*** | (2006.01) |

(52) U.S. Cl.

CPC ..... *A24F 1/32* (2013.01); *A24F 7/02* (2013.01); *A24F 9/02* (2013.01); *A24F 15/015* (2020.01); *A24F 40/20* (2020.01); *A24F 40/40* (2020.01); *E05C 19/16* (2013.01); *H05B 3/44* (2013.01)

(58) Field of Classification Search

CPC .. A24F 1/32; A24F 40/40; A24F 40/20; A24F 40/85; A24F 47/002; A24F 47/008; A24F 15/01; E05C 19/16

See application file for complete search history.

(56) References Cited

U.S. PATENT DOCUMENTS

| | | | | |
|---|---|---|---|---|
| 2007/0164066 | A1* | 7/2007 | Jones | B60R 9/055 224/328 |
| 2012/0255546 | A1* | 10/2012 | Goetz | A61M 15/0038 128/202.21 |
| 2013/0042865 | A1* | 2/2013 | Monsees | A24F 40/60 128/203.27 |

* cited by examiner

*Primary Examiner* — Michael H. Wilson
*Assistant Examiner* — Stephanie Lynn Moore

(57) ABSTRACT

A tobacco heater with straight through heating tube, comprising a housing with a replaceable battery and a control PCB board; the housing has a mouthpiece; each side of the housing is hinged with an openable seagull door; inside the door is a heating tube at the middle housing; between the mouthpiece and the tube is an airflow path; inside each door is a compress tool for blocking the tobacco; the tube is electrically connected to the board. An openable seagull door is hinged on both sides of the housing to block the tube formed on the inner side of the door in the housing middle to form a straight through tobacco heating container. Tobaccos can be quickly and easily loaded by opening the doors, and the heater can be powered on when closed doors; opening doors, the tobacco heating residues can be easily and quickly cleaned after using.

10 Claims, 2 Drawing Sheets

TOBACCO HEATER WITH STRAIGHT THROUGH HEATING TUBE

BACKGROUND OF THE INVENTION

1. Field of the Invention

The invention relates to electronic cigarettes, and in particular, to a tobacco heater with straight through heating tube, which is used for replacing the traditional combustion method to produce smoke that can be sucked by means of tobacco evaporation.

2. Description of the Related Art

There are more than one billion smokers in the world, and the main ingredients in the process of smoking include nicotine, carbon monoxide, tar, etc., and the active ingredient of cigarettes is nicotine, while most of the other ingredients are harmful to the human body, so many people die every year because of smoking. Therefore, smoking is banned in many public places, and even banned in some countries. However, people who are addicted to smoking have to smoke. In response to this demand, there are various kinds of electronic cigarettes on the market; however, the taste of electronic cigarettes and paper cigarettes are too different to meet the demands of smokers. In response to the problems above, tobacco heaters with heating tube have been used, but conventional tobacco heaters with heating tube generally use glass beakers, and air inflow holes are added at the bottom of the glass beaker to achieve air inflow. However, such a structure has problems that the tobacco is inconvenient to be added, and the tobacco heating residues cannot be cleaned up and is troublesome.

SUMMARY OF THE INVENTION

The technical issues to be solved by the invention: in view of the issues set forth in the prior art, a tobacco heater with straight through heating tube is disclosed. The invention has an openable seagull door hinged on both sides of the housing to block the heating tube formed on the inner side of the seagull door in the middle of the housing to form a straight through tobacco heating container. Tobaccos can be quickly and easily loaded by opening the seagull doors, and the heater can be powered on when closed seagull doors; opening seagull doors, the tobacco heating residues can be easily and quickly cleaned after using.

In order to solve the technical issues above, the invention adopts the technical solutions as follows:

The invention discloses a tobacco heater with straight through heating tube, comprising a housing with a replaceable battery and a control PCB board inside, and the housing is provided with a mouthpiece, wherein each side of the housing is hinged with an openable seagull door; the middle of the housing is provided with a heating tube inside the seagull door; between the mouthpiece and the heating tube is provided with an airflow path; the inside of each seagull door is provided with a compress tool for blocking the tobacco in the heating tube; the heating tube is electrically connected to the control PCB board.

Preferably, the seagull door is provided with a mounting cavity; the compress tool is provided with a connecting rod; the connecting rod is embedded in the mounting cavity, and the connecting rod is sleeved on a spring; one end of the spring abuts against the compress tool, and the other end thereof abuts against the inner wall of the mounting cavity.

Preferably, the mounting cavity is composed of a mounting tube on the seagull door and a silicone sleeve sleeved on the mounting tube; the connecting rod and the spring are disposed in the mounting tube, and the connecting rod passes through the silicone sleeve such that the compress tool is positioned outside the silicone sleeve.

Preferably, the compress tool is spherical.

Preferably, the compress tool is made of ceramic.

Preferably, the inside of each seagull door is provided with a first magnetic element; both sides of the housing are provided with a second magnetic element disposed opposite to the first magnetic element; a magnetic adsorption force is formed between the second magnetic element and the first magnetic element so that the seagull door is attached to the housing.

Preferably, the outer wall of the heating tube is sleeved with a thermal-insulation aerogel sleeve.

Preferably, both ends of the heating tube are provided with a fixed mounting sleeve inside the housing, and the two ends of the heating tube are respectively supported and fixed on the fixed mounting sleeve via a fixing silicone sleeve.

Preferably, the airflow path between the mouthpiece and the heating tube is provided a tobacco filter screen, and the tobacco filter screen is in stuck arrangement on the housing and is positioned inside the seagull door.

Preferably, an air-guiding tube is inserted into the airflow path, and the end of the air-guiding tube is provided with a sealing silicone sleeve; the mouthpiece passes through the sealing silicone sleeve, then it is inserted as well as slidably disposed in the air-guiding tube and is in an interference fit with the sealing silicone sleeve.

Compared with the prior art, the invention has the following advantageous:

1. The invention heats the tobacco by the straight through glass heating cup to form smoke for the smoker to suck, and replaces the combustion form of traditional electronic cigarettes by evaporating the tobacco, which has the advantage of real taste compared with traditional electronic cigarettes.

2. The housing of the invention is further provided with a straight through glass heating cup for placing the tobacco composition, and the replaceable battery is electrically connected to the straight through glass heating cup through a control unit, and the tobacco is heated by the straight through glass heating cup to form smoke, which replaces the traditional combustion method by evaporation. No harmful substances such as soot and tar are generated during smoking, and second-hand smoke is not generated due to the evaporated smoke; the invention is beautiful in appearance, small in size and convenient in use.

3. The invention has an openable seagull door hinged on both sides of the housing to block the heating tube formed on the inner side of the seagull door in the middle of the housing to form a straight through tobacco heating container. Tobaccos can be quickly and easily loaded by opening the seagull doors, and the heater can be powered on when closed seagull doors; opening seagull doors, the tobacco heating residues can be easily and quickly cleaned after using.

4. The heating component of the invention is a straight through heating tube, which can be prepared by using materials such as glass and ceramics as needed, and the regular structure processing cost is lower.

Figure 1:
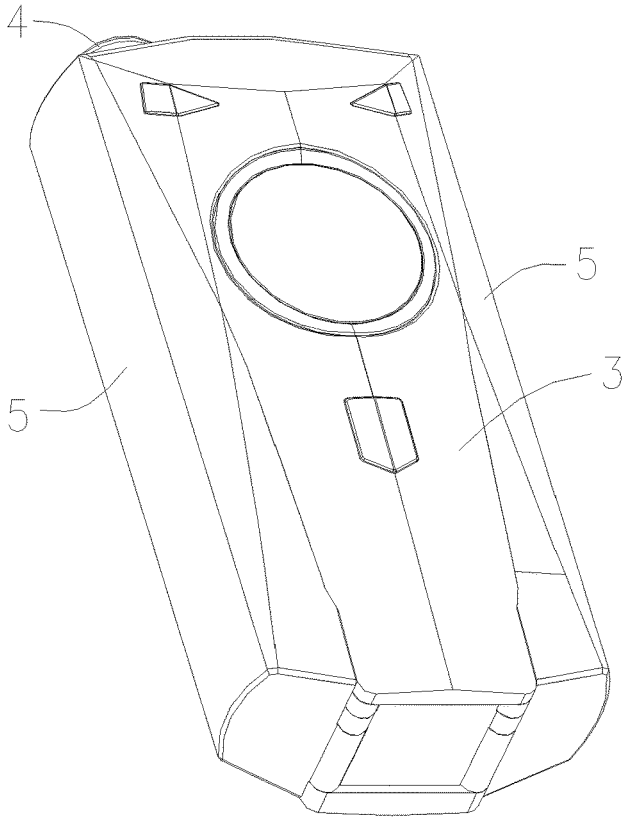
FIG. 1 is a perspective view illustrating the structure of the embodiment of the invention.
Figure 2:
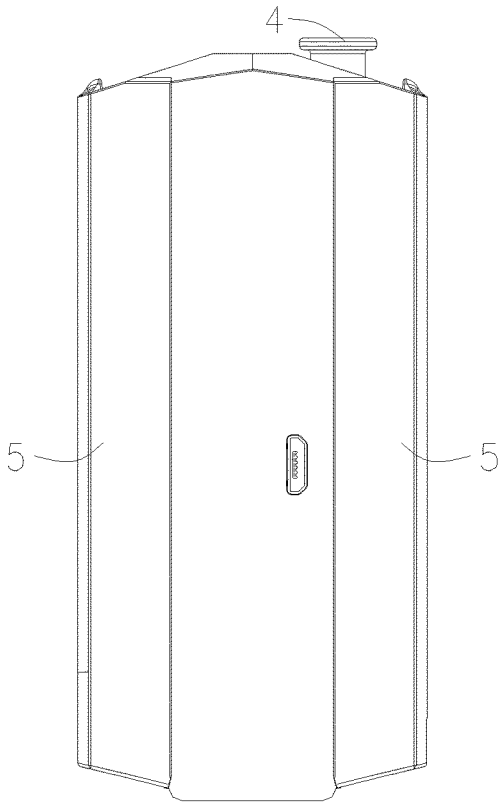
FIG. 2 is a rear view illustrating the structure of the embodiment of the invention.

In the figures, 1 refers to the replaceable battery; 2 refers to the control PCB board; 3 refers to the housing; 31 refers to the second magnetic element; 32 refers to the fixed mounting sleeve; 4 refers to the mouthpiece; 41 refers to the airflow path; 42 refers to the tobacco filter screen; 43 refers to the air-guiding tube; 44 refers to the sealing silicone sleeve; 5 refers to the seagull door; 50 refers to the mounting cavity; 501 refers to the mounting tube; 502 refers to the silicone sleeve; 51 refers to the compress tool; 511 refers to the connecting rod; 512 refers to the spring; 52 refers to the first magnetic element; 6 refers to the heating tube; 61 refers to the thermal-insulation aerogel sleeve; 62 refers to the fixing silicone sleeve.

PREFERRED EMBODIMENTS OF THE INVENTION

As shown in FIGS. 1, 2, 3 and 4, the tobacco heater with straight through heating tube of the embodiment comprises a housing 3 with a replaceable battery 1 and a control PCB board 2 inside, and the housing 3 is provided with a mouthpiece 4, wherein each side of the housing 3 is hinged with an openable seagull door 5; the middle of the housing 3 is provided with a heating tube 6 inside the seagull door 5; between the mouthpiece 4 and the heating tube 6 is provided with an airflow path 41; the inside of each seagull door 5 is provided with a compress tool 51 for blocking the tobacco in the heating tube 6; the heating tube 6 is electrically connected to the control PCB board 2. In the embodiment, the heating tube 6 is specifically a glass tube; in addition, a ceramic tube can be used as needed, and in order to facilitate cleaning of the tobacco residues, glazing treatment is suitable for the inner wall of the ceramic tube.

Figure 3:
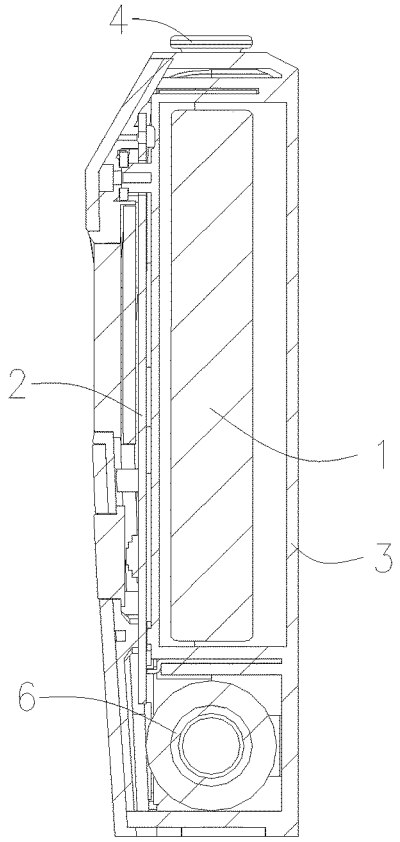
FIG. 3 is longitudinal sectional view illustrating the structure of the embodiment of the invention.
Figure 4:
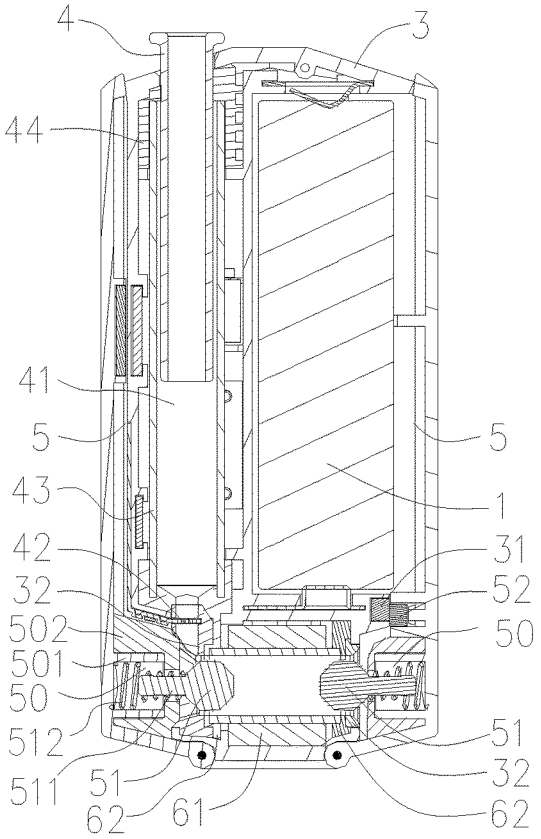
FIG. 4 is a transverse sectional view illustrating the structure of the embodiment of the invention.

As shown in FIGS. 3 and 4, the seagull door 5 is provided with a mounting cavity 50; the compress tool 51 is provided with a connecting rod 511; the connecting rod 511 is embedded in the mounting cavity 50, and the connecting rod 511 is sleeved on a spring 512; one end of the spring 512 abuts against the compress tool 51, and the other end thereof abuts against the inner wall of the mounting cavity 50. The elastic extrusion structure is realized through the above structure, and the same spring 512 structure can achieve the degree of extrusion of the tobacco fixing force so that the tobacco achieves a fixed degree of looseness, which ensures that the air pressure damping feeling of the smoking is consistent; different looseness adjustments can be achieved with springs 512 of different spring forces.

As shown in FIGS. 3 and 4, the mounting cavity 50 is composed of a mounting tube 501 on the seagull door 5 and a silicone sleeve 502 sleeved on the mounting tube 501; the connecting rod 511 and the spring 512 are disposed in the mounting tube 501, and the connecting rod 511 passes through the silicone sleeve 502 such that the compress tool 51 is positioned outside the silicone sleeve 502. The above structure enables the compress tool 51 and the spring 512 easy to be installed: passing the connecting rod 511 sleeved with the spring 512 through the silicone sleeve 502, and sleeving the silicone sleeve 502 into the mounting tube 501.

As shown in FIGS. 3 and 4, the compress tool 51 is spherical. On the one hand, it is possible to prevent the collision with the heating tube 6, and on the other hand, the pressing force generated by the spherical structure is relatively uniform, and it is not easy to crush the heating tube 6.

In the embodiment, the compress tool 51 is made of ceramic, which has good heat resistance and does not generate odor when heated.

As shown in FIG. 4, the inside of each seagull door 5 in the embodiment is provided with a first magnetic element 52; both sides of the housing 3 are provided with a second magnetic element 31 disposed opposite to the first magnetic element 52; a magnetic adsorption force is formed between the second magnetic element 31 and the first magnetic element 52 so that the seagull door 5 is attached to the housing 3; the seagull door 5 adopts a magnetic adsorption structure to make the opening convenient and the closure firm and reliable.

As shown in FIGS. 3 and 4, the outer wall of the heating tube 6 is sleeved with a thermal-insulation aerogel sleeve 61; insulating is performed to the heating tube 6 so that the internal temperature of the housing 3 is low, and the heating efficiency of the heating tube 6 can be ensured; in addition, the thermal-insulation aerogel sleeve 61 on the outer wall of the heating tube 6 may be made of other thermal-insulating materials as needed.

As shown in FIGS. 3 and 4, both ends of the heating tube 6 are provided with a fixed mounting sleeve 32 inside the housing 3, and the two ends of the heating tube 6 are respectively supported and fixed on the fixed mounting sleeve 32 via a fixing silicone sleeve 62. The mounting and fixing of the heating tube 6 can be conveniently achieved, and the heat of the heating tube 6 can be prevented from being directly transmitted to the housing 3 and to cause the temperature of the housing 3 to be too high.

As shown in FIGS. 3 and 4, the airflow path 41 between the mouthpiece 4 and the heating tube 6 is provided a tobacco filter screen 42, and the tobacco filter screen 2 is in stuck arrangement on the housing 3 and is positioned inside the seagull door 5; the tobacco filter screen 42 can filter the airflow path 41 to prevent the tobacco in the heating tube 6 from entering into the mouthpiece 4 along the airflow path 41; at the same time, as the tobacco filter screen 2 is in stuck arrangement on the housing 3 and is positioned inside the seagull door 5, it is also convenient to take out the tobacco filter screen 42 for cleaning the inner wall of the heating tube 6, and to quickly remove the tobacco residues in the inner wall of the heating tube 6. In the embodiment, the tobacco filter screen 42 is provided with a handle for quick removal from the housing 3.

As shown in FIGS. 3 and 4, an air-guiding tube 43 is inserted into the airflow path 41, and the end of the air-guiding tube 43 is provided with a sealing silicone sleeve 44; the mouthpiece 4 passes through the sealing silicone sleeve 44, then it is inserted as well as slidably disposed in the air-guiding tube 43 and is in an interference fit with the sealing silicone sleeve 44. With the above structure, the mouthpiece 4 has a telescopic function, and can be inserted into the air-guiding tube 43 when it is not in use to protect the mouthpiece 4, and can be pulled out from the air-guiding tube 43 to facilitate use. In the embodiment, the mouthpiece 4 specifically adopts a glass mouthpiece.

In the embodiment, the control PCB board 2 is provided with multiple buttons and a display screen, and the exterior of the housing 3 is provided with corresponding buttons and a display screen cover; the back of the housing 3 is provided with a Micro USB charging interface, and the Micro USB charging interface is connected to the control PCB board 2 for charging the replaceable battery 1 (lithium ion battery or lithium polymer battery); the control PCB board 2 is provided with a charging circuit for adjusting the charging current and voltage, and the replaceable battery 1 is connected to the Micro USB charging interface through the charging circuit.

The using method of the tobacco heater with straight through heating tube of the embodiment is as follows:

1) opening one or two seagull doors 5 such that the end of the heating tube 6 is exposed so as to adding the tobacco thereto;

2) closing all the seagull doors 5 so that the compress tool 51 squeezes the tobacco from both ends;

3) activing the control PCB board 2 by the button to supply power to the heating tube 6, and the heating tube 6 starts to heat the tobacco; when the smoker smokes, one end of the heating tube 6 serves as an air inlet and the other end serves as an air outlet; the atomized smoke is output to the mouthpiece 4 through the airflow path 41, and enters into the mouth of the smoker through the mouthpiece 4. In the embodiment, the automatic temperature control is further realized: the heating tube 6 is provided with a temperature sensor connected to the control PCB board 2; the control PCB board 2 controls the heating state of the heating tube 6 according to the temperature detected by the temperature sensor in an operating state to maintain the operating temperature between 100° C. and 250° C.; when the temperature detected by the temperature sensor reaches 250° C., the heating tube 6 is controlled to stop heating, and when the temperature detected by the temperature sensor is lower than 100° C., the heating tube 6 is controlled to heat.

The above description is only a preferred embodiment of the invention, and the protection scope of the invention is not limited thereto, and all technical solutions within the inventive concept of the invention belong to the protection scope of the invention. It should be noted that any improvements and modifications made by those skilled in the art without departing from the principles of the invention shall all fall within the protection scope of the invention.

The invention claimed is:

1. A tobacco heater with straight through heating tube, comprising a housing (3) with a replaceable battery (1) and a control PCB board (2) inside, and the housing (3) is provided with a mouthpiece (4), wherein each side of the housing (3) is hinged with an openable seagull door (5); the middle of the housing (3) is provided with a heating tube (6) inside the seagull door (5); between the mouthpiece (4) and the heating tube (6) is provided with an airflow path (41); the inside of each seagull door (5) is provided with a compress tool (51) for blocking the tobacco in the heating tube (6); the heating tube (6) is electrically connected to the control PCB board (2).

2. The tobacco heater with straight through heating tube according to claim 1, wherein the seagull door (5) is provided with a mounting cavity (50); the compress tool (51) is provided with a connecting rod (511); the connecting rod (511) is embedded in the mounting cavity (50), and the connecting rod (511) is sleeved on a spring (512); one end of the spring (512) abuts against the compress tool (51), and the other end thereof abuts against the inner wall of the mounting cavity (50).

3. The tobacco heater with straight through heating tube according to claim 1, wherein the mounting cavity (50) is composed of a mounting tube (501) on the seagull door (5) and a silicone sleeve (502) sleeved on the mounting tube (501); the connecting rod (511) and the spring (512) are disposed in the mounting tube (501), and the connecting rod (511) passes through the silicone sleeve (502) such that the compress tool (51) is positioned outside the silicone sleeve (502).

4. The tobacco heater with straight through heating tube according to claim 1, wherein the compress tool (51) is spherical.

5. The tobacco heater with straight through heating tube according to claim 1, wherein the compress tool (51) is made of ceramic.

6. The tobacco heater with straight through heating tube according to claim 1, wherein the inside of each seagull door (5) is provided with a first magnetic element (52); both sides of the housing (3) are provided with a second magnetic element (31) disposed opposite to the first magnetic element (52); a magnetic adsorption force is formed between the second magnetic element (31) and the first magnetic element (52) so that the seagull door (5) is attached to the housing (3).

7. The tobacco heater with straight through heating tube according to claim 1, wherein the outer wall of the heating tube (6) is sleeved with a thermal-insulation aerogel sleeve (61).

8. The tobacco heater with straight through heating tube according to claim 1, wherein both ends of the heating tube (6) are provided with a fixed mounting sleeve (32) inside the housing (3), and the two ends of the heating tube (6) are respectively supported and fixed on the fixed mounting sleeve (32) via a fixing silicone sleeve (62).

9. The tobacco heater with straight through heating tube according to claim 1, wherein the airflow path (41) between the mouthpiece (4) and the heating tube (6) is provided a tobacco filter screen (42), and the tobacco filter screen (42) is in stuck arrangement on the housing (3) and is positioned inside the seagull door (5).

10. The tobacco heater with straight through heating tube according to claim 1, wherein an air-guiding tube (43) is inserted into the airflow path (41), and the end of the air-guiding tube (43) is provided with a sealing silicone sleeve (44); the mouthpiece (4) passes through the sealing silicone sleeve (44), then it is inserted as well as slidably disposed in the air-guiding tube (43) and is in an interference fit with the sealing silicone sleeve (44).

* * * * *